US006435984B1

(12) United States Patent
Ohama

(10) Patent No.: US 6,435,984 B1
(45) Date of Patent: Aug. 20, 2002

(54) GOLF BALL

(75) Inventor: Keiji Ohama, Akashi (JP)

(73) Assignee: Sumitomo Rubber Industries Limited, Kobe (JP)

( * ) Notice: Subject to any disclaimer, the term of this patent is extended or adjusted under 35 U.S.C. 154(b) by 0 days.

(21) Appl. No.: 09/521,104

(22) Filed: Mar. 7, 2000

(30) Foreign Application Priority Data

Mar. 9, 1999 (JP) ..... 11-062278

(51) Int. Cl.[7] ..... A63B 37/04; A63B 37/06; A63B 37/00

(52) U.S. Cl. ..... 473/377; 473/378; 473/351

(58) Field of Search ..... 473/351, 365, 473/377, 378

(56) References Cited

U.S. PATENT DOCUMENTS 4,798,386 A * 1/1989 Berard ..... 264/239
5,820,489 A * 10/1998 Sullivan et al. ..... 473/377
5,823,890 A * 10/1998 Maruko et al. ..... 473/354
6,022,279 A * 2/2000 Yamagishi et al. ..... 473/353

FOREIGN PATENT DOCUMENTS

JP A10-155937 6/1998

OTHER PUBLICATIONS

Callister, Jr., William D., Materials Science and Engineering: An Introduction, 4th Edition., New York: John Wiley & Sons, Inc. copyright 1997, pp. 488–489, 706–707.*

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

The present invention provides a golf ball with a pale color that has a bright color tone, maintains visibility without giving incongruous feeling to a golfer during shot, and has high resistance against discoloration due to ultraviolet rays. The golf ball comprises a golf ball body and a layer formed on the body. The colored layer contains a white inorganic pigment and/or a white organic pigment, a coloring inorganic pigment and/or a coloring organic pigment, and a fluorescent pigment. When the color tone of the golf ball is represented by the Lab system, values of "L", "a" and "b" satisfy the following relationships:

$$L \geqq 82$$

$$10 \leqq (a^2+b^2)^{1/2} \leqq 45.$$

14 Claims, 1 Drawing Sheet

GOLF BALL

This application is based on patent application No. 11-62278 filed in Japan, the contents of which is hereby incorporated by reference.

BACKGROUND OF THE INVENTION

1. Field of the Invention

The present invention relates to a colored golf ball dyed in a pale color, and more specifically, to a colored golf ball having good discoloring resistance including yellowing discoloring.

2. Description of the Related Art

Majority of golf balls currently used are white, most of which having surface layer made of a composition that contains a white pigment such as titanium oxide and a fluorescent whitener thereby to increase the brightness.

Besides the white golf balls, colored golf balls are commercially available. Most of the colored balls are dyed in deep colors so as to be noticeable on lawn that becomes whitish in winter. Colored balls having deep colors as described above have such advantages as being easier to be recognized on a golf course when viewed from a distant position, easier to track the trajectory thereof after the shot, locate the landing point and distinguish from other players' balls than white golf balls also in a season other than winter. In spite of such various superior advantages than those of the white ball, the colored balls are not used so widely.

The reason why the deep -colored balls are not popular is supposed to be the incongruous feeling for golfers who are accustomed to the white balls. A pale-colored golf ball having L value of 80 or higher, a value ranging from −30 to +30 and b value ranging from −30 to +30 has recently been suggested in Japanese Unexamined Patent Publication No. 10-155937, as a colored ball that would be acceptable to golfers, who prefer white balls, without incongruous feeling.

The publication quoted above does not mention a particular coloring agent used to obtain the pale-colored golf ball. Moreover, since no description on the type of the coloring agent is given at all, no information is available as to whether an organic pigment is used or not, an inorganic pigment is used or not, and whether a fluorescent pigment is used or not.

On the other hand, a conventional colored golf ball dyed in a deep color is less likely to experience a problem of discoloration than the white ball, and therefore has not been subject to improvements to make it resistant against discoloration due to ultraviolet rays and heat. In the case of the pale-colored golf ball, however, discoloration due to ultraviolet rays causes more trouble due to the color thereof that is nearer to white, than the deep-colored balls.

Brightness as that of a white ball cannot be achieved simply by mixing a coloring organic pigment and/or a coloring inorganic pigment used to give yellow, blue, pink, orange or other color with a white pigment used to make the color paler.

Also a pale color obtained by mixing a coloring organic pigment and/or a coloring inorganic pigment with a white pigment is difficult to distinguish from other color when viewed from a distance. Consequently, the pale-colored ball is difficult to distinguish in flight in such a weather as cloudy or rainy when the background is whitish, and is not able to demonstrate such an intrinsic advantage of the colored ball as the trajectory is easily recognized.

SUMMARY OF THE INVENTION

The invention has been accomplished under these circumstances, and, accordingly, it is an object of the invention to provide a golf ball having a pale color of bright color tone that ensures high visibility and does not give incongruous feeling on shot, with the color being resistant to discoloration due to ultraviolet rays or other causes.

The present invention is directed to a golf ball comprising a golf ball body and a colored layer formed on the ball body, the colored layer containing a white inorganic pigment and/or a white organic pigment, a coloring inorganic pigment and/or a coloring organic pigment, and a fluorescent pigment. When the color tone of the golf ball is represented by the Lab system, values of "L", "a" and "b" satisfies the following relationships.

$$L \geqq 82$$

$$10 \leqq (a^2+b^2)^{1/2} \leqq 45$$

The present invention provides, in another aspect, a golf ball comprising a core and a cover formed on the core. The cover is colored by containing a white inorganic pigment and/or a white organic pigment, a coloring inorganic pigment and/or a coloring organic pigment, and a fluorescent pigment. When the color tone of the golf ball is represented by the Lab system, values of "L", "a" and "b" satisfies the following relationships.

$$L \geqq 82$$

$$10 \leqq (a^2+b^2)^{1/2} \leqq 45$$

These and other objects, features, aspects, and advantages of the present invention will become more apparent from the following detailed description of the preferred embodiments/examples with the accompanying drawings.

DESCRIPTION OF THE PREFERRED EMBODIMENTS

Figure 1:
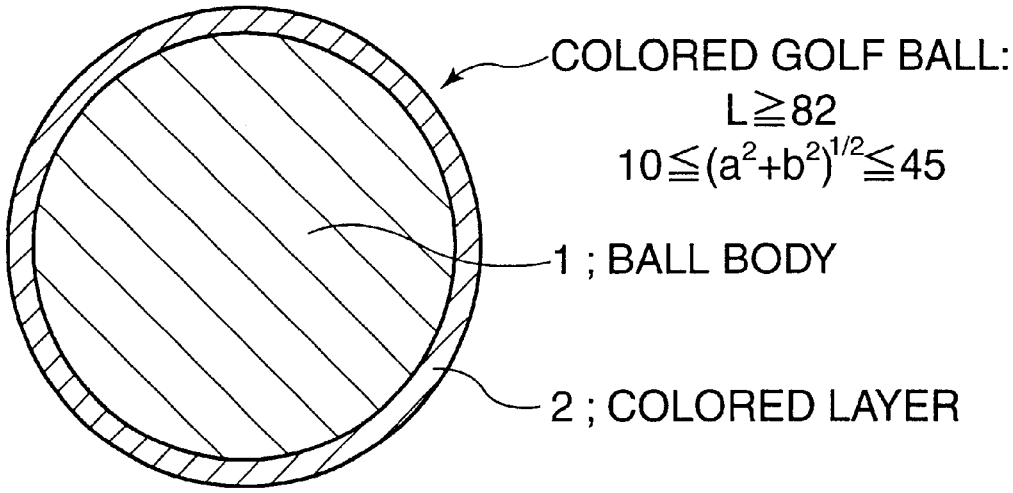
FIG. 1 is a cross sectional view of a colored golf ball of the invention illustrating a body 1 and a colored layer 2 formed on the body 1.
Figure 2:
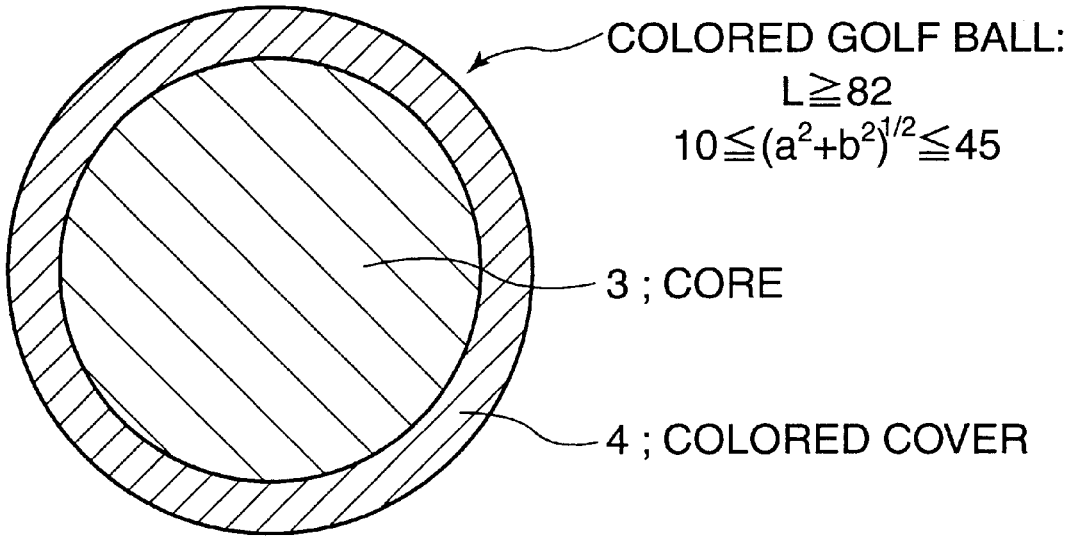
FIG. 2 is a cross sectional view of a colored golf ball of the invention illustrating a core 3 and a colored cover 4 formed on the core 3.

A golf ball of the present invention comprises a golf ball body and a colored layer formed on the body. The colored layer contains a white inorganic pigment and/or a white organic pigment (hereinafter collectively referred to as "white pigment" when an inorganic pigment and an organic pigment are not distinguished), a coloring inorganic pigment and/or a coloring organic pigment (may be collectively referred to as "non-fluorescent coloring pigment" hereinafter), and a fluorescent pigment, such that values of "L", "a" and "b" satisfy the following relationships when the color tone of the golf ball is represented by the Lab system.

$$L \geqq 82$$

$$10 \leqq (a^2+b^2)^{1/2} \leqq 45$$

The ball body is one of the following: a vulcanized rubber body of an one-piece golf ball; a core of a multi-piece golf ball or a thread-wound golf ball; and a core and a cover formed on the core. When the ball body is the vulcanized rubber one of an one-piece golf ball, the colored layer (e.g. color coat) is formed on the ball body. When the ball body is the core, the cover formed on the ball body (i.e. core) is colored, that is, the colored cover constitutes a colored layer. When the ball body comprises the core and the cover, the colored layer (e.g. color coat) is formed on the cover.

According to the present invention, a clear coat, usually transparent, may be formed on the colored layer or the colored cover in order to obtain a favorable appearance.

Now the colored layer (colored cover) will be described below in detail.

The colored layer is a layer dyed in a color other than white, and contains a fluorescent pigment, a white pigment without fluorescence and a non-fluorescent coloring pigment.

The white pigment is contained for the purpose of giving a pale color that has hiding power to the colored layer. In other words, it is because adjusting the Lab values to achieve a color tone within the range described above simply by controlling the contents of the coloring pigments results in a difficulty with respect to the hiding power. When the non-fluorescent coloring pigment are used with the fluorescent pigment in the colored layer, it is made possible not only to achieve bright color tone, but also improve the resistance against discoloration due to ultraviolet rays and improve the distinctness and visibility of the colored golf ball.

The visibility refers to the ease of visually recognizing the golf ball on a golf course that has a whitish color such as snow or withered lawn in winter, and the ease of recognizing the trajectory against the background of cloudy sky. Given colors of similar densities, a colored ball containing a fluorescent pigment makes it easier to distinguish the color from a distance and distinguish the ball in any weather, cloudy, rainy or snowy, thus demonstrating the intrinsic effects of the colored ball.

Any of white organic pigment and white inorganic pigment can be used as the white pigment. Among these white pigments, white inorganic pigments such as titanium oxide, and zinc oxide are preferably used because of excellent heat resistance and weathering resistance.

As the non-fluorescent coloring pigment, a coloring inorganic pigment and a coloring organic pigment may be used individually or in combination with one another.

Usable coloring inorganic pigment include red pigments such as red iron oxide ($Fe_2O_3$), red lead oxide ($Pb_3O_4$), molybdenum red, and cadmium red; yellow pigments such as titanium yellow ($20TiO_2.NiO—Sb_2O_3$), litharge (PbO), chrome yellow ($PbCrO_4$), yellow oxide (FeO(OH)), and cadmium yellow; and blue pigments such as cobalt blue ($CoO.Al_2O_3$), prussian blue, and marine blue.

Examples of the coloring organic pigment include azo pigment, phthalocyanine pigment, and perylene pigment. An azo pigment is preferably used due to a good heat resistance and weathering resistance. Specific examples of the azo pigment include pigment yellow-1, pigment yellow-12, pigment red 3, pigment red 57, and pigment orange 13.

The fluorescent pigment is contained in the colored layer in order to enhance the brightness and visibility of the color. As the fluorescent pigment, an inorganic fluorescent pigment and an organic fluorescent may be used individually or in combination with one another.

The inorganic fluorescent pigment is obtained by adding a trace amount of activators and fluxes such as manganese, silver, copper, and lead to a main component such as oxide, sulfate, silicate, and tungsten salt of high-purity metals (e.g. zinc, cadmium, calcium, aluminum, and yttrium), followed by calcination at high temperature. Specific examples of the inorganic fluorescent pigment include CaS (Bi, purple), ZnS (Cu, yellowish green), ZnS (Mn, orange), and $Y_2O_3$ (Eu, red). Those enclosed in the parentheses indicate an element as an activator and a color made by the pigment, respectively.

The organic fluorescent pigment is obtained by forming a solid solution of a synthetic resin incorporated with a fluorescent dye into powders. Specific examples of the synthetic resin include formalin condensed resin, acrylic resin, and vinyl chloride resin. Specific examples of the fluorescent dye include rhodamine B, rhodamine 6G, azosole brilliant yellow 6G, and other fluorescent basic dyes. Although the inorganic fluorescent pigment is generally superior in heat resistance to the organic fluorescent pigment, the latter is preferably used because of cheap price and lower specific gravity than that of the former.

The golf ball of the present invention has such a color tone achieved by using the above- described pigments in combination as the values of "L", "a" and "b" satisfy the following relationships when the color tone is represented by the Lab system.

$$L \geqq 82$$

$$10 \leqq (a^2+b^2)^{1/2} \leqq 45$$

The Lab system representing the color tone is defined in JIS-Z-8729, and the color tone is measured by a colorimeter CR-221 of direct reading type manufactured by Minolta Camera Co., Ltd.

When the value of "L", that is an index of lightness, is 82 or higher, a bright pale color is made. Values of "a" and "b" are indices of hue. When the value of "a" is positive, a more reddish color is obtained and, when the value of "a" is negative, a yellowish hue is obtained. When the value of "b" is positive, a yellowish color is obtained and, when the value of "b" is negative, a bluish hue is obtained. When the value of $(a^2+b^2)^{1/2}$ is 10 or greater, coloration other than white can be recognized and such advantages of the conventional colored ball as the high distinctness and visibility can be maintained. In order to achieve better distinctness and visibility, the value of $(a^2+b^2)^{1/2}$ is preferably 15 or greater, more preferably 20 or greater, and most preferably 25 or greater. When the value of $(a^2+b^2)^{1/2}$ is set within 45, such a color ball is obtained that has a pale color (pink, orange, yellow, light blue, etc.) that does not give incongruous visual feeling to golfers who are accustomed to the white balls.

The inventive golf ball is pale-colored such that above-described relationship in Lab system is satisfied, therefore the golf ball has high distinctness and high visibility and is acceptable for golfers who are accustomed to the white balls. Since the golf ball has a colored layer or colored cover containing the white pigment, the fluorescent pigment and the non-fluorescent coloring pigment, discoloration resistance of the colored ball can be maintained.

There is no limitation to the color of the golf ball of the present invention as long as the Lab values satisfy the relationships described above, and pink, light blue, orange, yellow or other color obtained by using the white pigment, the fluorescent pigment and the non-fluorescent coloring pigment in combination can be employed for golf ball.

According to the present invention, the colored layer is preferably made from a composition comprising a resin and/or a rubber as a base material; the white inorganic pigment and the white organic pigment, namely white pigment, in the total amount of 0.5 to 6 parts by weight; the coloring organic pigment and the coloring inorganic pigment,. namely the non-fluorescent coloring pigment, in the total amount of 0.002 to 0.1 parts by weight; and the fluorescent pigment in the amount of 0.01 to 1.5 parts by weight; based on 100 parts by weight of the base material.

When the content of the white pigment is less than 0.5 parts by weight, hiding power becomes insufficient, and the content thereof in more than 6 parts by weight results in too pale hue that cannot demonstrate the effects of the color ball. When the content of the non-fluorescent coloring pigment is less than 0.002 parts by weight, coloration can hardly be achieved, and the content thereof in more than 0.1 parts by weight results in excessive coloration effect by the coloring pigment, thus leading to a dark hue. When the content of the fluorescent pigment is less than 0.01 parts by weight, sufficient effect of improving the visibility and brightness cannot be achieved, and the content thereof in more than 1.5 parts by weight results in too deep hue that gives incongruous feeling to golfers who are accustomed to the white balls.

When a golf ball comprises a core of a ball body and a colored, cover formed on the core, an ionomer is preferably employed as the base material of the composition for the colored cover. To sum up, in case of the golf ball having a colored cover, the cover is preferably made from a resin composition which comprises 100 parts by weight of an ionomer as a base material, 0.5 to 6 parts by weight of the white inorganic pigment, 0.002 to 0.1 parts by weight of the non-fluorescent coloring pigment, and 0.01 to 1.5 parts by weight of the fluorescent pigment.

Preferably, according to the present invention, the content ratio of the fluorescent pigment to the non-fluorescent coloring pigment in the colored layer, namely fluorescent pigment/non-fluorescent coloring pigment, is in a range from 10 to 50, and more preferably from 15 to 40. When the content ratio is higher than 50, excessive content of the fluorescent pigment results in marked discoloration. On the other hand, when the content ratio is lower than 10, it becomes difficult to obtain a bright color tone.

If desired, a well-known additives such as antioxidant, UV absorber, dispersing aids may be added to the composition for colored layer or colored cover.

EXAMPLES

The present invention is further illustrated by the following examples. It is to be understood that the present invention is not limited to the examples, and various changes and modifications may be made in the invention without departing from the spirit and scope thereof.

[Production of Colored Golf Balls]

Resin compositions for covers of colored golf balls Nos. 1–9 were prepared by adding pigments shown in Table 1 to 100 parts by weight of an ionomer mixture of HIMILAN #1605 and HIMILAN #1706, which are trade names of ionomers commercially available from Mitsui duPont Chemical Co., Ltd., at 1 to 1 ratio. A fluorescent pigment manufactured by DAYGLO Inc. and a coloring organic pigment manufactured by SUMIKA COLOR were used. As the white pigment, titanium oxide A-220 manufactured by Ishihara Sangyo Kaisha, Ltd. was used.

Colored cover layer was formed by extrusion molding of the prepared resin composition on a ball body, thereby obtaining a colored golf ball.

Thus formed colored balls Nos. 1–9 were tested by ten golfers who hit the balls with W#1 clubs, while evaluating the ease of tracking the ball trajectory, ease of recognizing the ball on snow-covered ground, uneasy feeling during addressing and degree of discoloration, according to the criteria described below. Conventional white ball (No. 10) was tested similarly for comparison.

Results of evaluation are shown in Table 1.

[Procedure of Evaluation]

(1) Visibility at Distance

Ten golfers hit colored golf balls Nos. 1–9 with W#1 clubs and evaluated the ease of tracking the ball trajectory in comparison to that of the white ball No. 10. The mark "◎" represents that eight or more golfers evaluated the colored ball better than the white one. The mark "○" represents that six or seven golfers evaluated the colored ball better than the white one. The mark "Δ" represents that four or five golfers evaluated the colored ball better than the white one. The mark "x" represents that three or less golfers evaluated the colored ball better than the white one.

(2) Visibility on Snow-covered Ground

Ten golfers watched a ball placed on snow from a distance of 20 yards, and evaluated whether the ball could be visually distinguished or not. The mark "◎" represents that eight or more golfers could distinguish the ball. The mark "○" represents that six or seven golfers could distinguish the ball. The mark "Δ" represents four or five golfers could distinguish the ball. The mark "x" represents three or less golfers could distinguish the ball.

(3) Incongruous Feeling During Addressing

Ten golfers watched a ball placed at a small distance, and evaluated whether the ball gave an incongruous feeling or not. The mark "◎" represents that eight or more golfers did not feel incongruity. The mark "○" represents that six or seven golfers did not feel incongruity. The mark "Δ" represents four or five golfers did not feel incongruity. The mark "X" represents three or less golfers did not feel incongruity.

(4) Discoloration of a Colored Ball

After leaving a ball outdoors for one week, Lab values were measured by a colorimeter (CR-221 manufactured by Minolta Camera Co., Ltd.). Differences between the Lab values measured immediately after the ball was produced and the Lab values measured after being left outdoors for one week, namely ΔL, Δa, and Δb, were substituted in the following equation. Discoloration was evaluated by the value of E calculated with this equation. Greater value of E indicates greater degree of discoloration.

$$E=[(\Delta L)^2+(\Delta a)^2+(\Delta b)^2]^{1/2}$$

TABLE 1

| | | No. | 1 | 2 | 3 | 4 | 5 | 6 | 7 | 8 | 9 | 10 |
|---|---|---|---|---|---|---|---|---|---|---|---|---|
| Coloring pigment (parts by weight) | Fluorescent pigment | ZQ11 | 0.2 | — | 0.1 | — | — | — | — | — | — | — |
| | | ZQ14 | — | 0.5 | 0.3 | — | 3.0 | — | — | 0.6 | — | — |
| | | ZQ17 | — | — | — | 0.2 | — | — | — | — | — | — |
| | Organic pigment | PR117 | 0.01 | — | — | — | — | 0.4 | — | — | — | — |
| | | PR216 | — | 0.03 | 0.01 | — | — | — | 0.005 | — | 0.003 | — |
| | | PR347 | — | — | — | 0.005 | — | — | — | — | 0.005 | — |
| White pigment (parts by weight) | | Titanium oxide | 2.0 | 2.0 | 2.0 | 2.0 | 2.0 | 2.0 | 2.0 | 2.0 | 4.0 | 3.0 |

TABLE 1-continued

| | No. | 1 | 2 | 3 | 4 | 5 | 6 | 7 | 8 | 9 | 10 |
|---|---|---|---|---|---|---|---|---|---|---|---|
| Content ratio of fluorescent pigment to non-fluorescent coloring pigment | | 20 | 16.7 | 40 | 40 | — | — | — | — | — | — |
| Color tone | Tinge | Pink | Orange | Orange | Yellow | Orange | Pink | Orange | Orange | Orange | White |
| | L value | 88 | 86 | 89 | 92 | 78 | 63 | 89 | 85 | 89 | 90 |
| | a value | 26 | 20 | 22 | −7 | 51 | 38 | 4 | 21 | 7 | 0.2 |
| | b value | 8 | 35 | 23 | 25 | 64 | 14 | 8 | 37 | 19 | 0.2 |
| | $(a^2 + b^2)^{1/2}$ | 27 | 40 | 32 | 26 | 82 | 40 | 9 | 43 | 20 | 0.3 |
| Evaluation | Visibility at distance | ◎ | ◎ | ◎ | ◎ | ○ | Δ | x | ◎ | Δ | — |
| | Visibility on snow | ◎ | ◎ | ◎ | ◎ | ◎ | ◎ | x | ◎ | ◎ | — |
| | Incongruous feeling | ◎ | ○ | ◎ | ◎ | Δ | Δ | ◎ | ◎ | ◎ | — |
| | Discoloration | 8 | 9 | 8 | 7 | 30 | 5 | 3 | 20 | 5 | 3 |

Results of Nos. 6, 7 and 9 show that the golf ball having the colored layer that does not contain the fluorescent pigment has lower visibility, especially visibility at a distance, than the golf balls Nos. 2 and 3 that have comparable values of L factor.

Results of Nos. 5 and 8, whose covers were colored by using only the fluorescent pigment without a non-fluorescent pigment, show that the degree of discoloration is higher. Thus it can be seen that it is necessary to add a non-fluorescent organic pigment or inorganic pigment for the coloring pigment in order to ensure resistance against discoloration due to ultraviolet rays.

Results of Nos. 5 and 6 show that L value lower than 80 leads to incongruous feeling during addressing.

The golf balls Nos. 1 through 4 that have the values of "L", "a" and "b" within the ranges specified in the present invention and use both of the fluorescent pigment and the organic pigment show discoloration resistance and high visibility, without giving incongruous feeling during addressing.

The present invention has been described with reference to the present embodiments. Obviously, modifications and alterations will occur to others upon reading and understanding the proceeding detailed description. It is indeed that the present invention be construed as including all such modifications and alterations insofar as they come within the scope of the attended claims or the equivalents thereof.

What is claimed is:

1. A golf comprising:

A golf ball body and a colored layer formed on the ball body, the colored layer containing a white inorganic pigment and/or a white organic pigment, a coloring inorganic pigment and/or a coloring organic pigment, and a fluorescent pigment, wherein values of L, a and b satisfy the following relationships when the color tone of the golf ball is represented by the Lab system:

$$L \geqq 82$$

$$10 \leqq (a^2+b^2)^{1/2} \leqq 45,$$

wherein the colored layer is made from a composition comprising:

100 parts by weight of a resin and/or a rubber as a base material;

0.5 to 6 parts by weight in total of the white inorganic pigment and the white organic pigment;

0.002 to 0.1 parts by weight in total of the coloring inorganic pigment and the coloring organic pigment; and 0.01 to 1.5 parts by weight of the fluorescent pigment, and wherein the content ratio of the fluorescent pigment to the total of the coloring organic pigment and the coloring inorganic pigment ranges from 10 to 50.

2. A golf ball according to claim 1, wherein the ball body comprises a core and a cover formed on the core, and the colored layer is formed on the cover.

3. A golf ball according to claim 1 further comprising from 0.01 to less than 1 part by weight of the fluorescent pigment.

4. A golf ball according to claim 1, further comprising a clear coat formed on the colored layer.

5. A golf ball according to claim 1, wherein values of L, a and b satisfy the following relationships when the color tone of the golf ball is represented by the Lab system:

$$L \geqq 82$$

$$25 \leqq (a^2+b^2)^{1/2} \leqq 45.$$

6. A golf ball according to claim 5, wherein the ball body comprises a core and a cover formed on the core, and the colored layer is formed on the cover.

7. A golf ball:according to claim 5, further comprising from 0.01 to less than 1 part by weight of the fluorescent pigment.

8. A golf ball according to claim 5, further comprising a clear coat formed on the colored layer.

9. A golf ball comprising:

a core, and a cover formed on the core, the cover containing a white inorganic pigment and/or a white organic pigment, a coloring inorganic pigment and/or a coloring organic pigment, and a fluorescent pigment, wherein values of L, a and b satisfy the following relationships when the color tone of the golf ball is represented by the Lab system:

$$L \geqq 82$$

$$10 \leqq (a^2+b^2)^{1/2} \leqq 45,$$

wherein the cover is made from a resin composition comprising:

100 parts by weight of an ionomer as a base material;

0.5 to 6 parts by weight in total of the white inorganic pigment and the white organic pigment;

0.002 to 0.1 parts by weight in total of the coloring inorganic pigment and the coloring organic pigments; and 0.01 to 1.5 parts by weight of the fluorescent pigment, and wherein the content ratio of the fluorescent pigment to the total of the coloring organic pigment and the coloring inorganic pigment ranges from 10 to 50.

10. A golf ball according to claim 9, further comprising from 0.01 to less than 1 part by weight of the fluorescent pigment.

11. A golf ball according to claim 9, further comprising a clear coat formed on the colored layer.

12. A golf ball according to claim 9, wherein values of L, a and b satisfy the following relationships when the color tone of the golf ball is represented by the Lab system:

$$L \geqq 82$$

$$25 \leqq (a^2+b^2)^{1/2} \leqq 45.$$

13. A golf ball according to claim 12, further comprising from 0.01 to less than 1 part by weight of the fluorescent pigment.

14. A golf ball according to claim 13, further comprising a clear coat formed of the colored layer.

* * * * *